US011236533B2

(12) United States Patent
Tamura et al.

(10) Patent No.: US 11,236,533 B2
(45) Date of Patent: Feb. 1, 2022

(54) LATCH DEVICE FOR VEHICLE TRUNK LID

(71) Applicant: MITSUI KINZOKU ACT CORPORATION, Yokohama (JP)

(72) Inventors: Shunsuke Tamura, Yokohama (JP); Toshio Takenaka, Yokohama (JP)

(73) Assignee: Mitsui Kinzoku Act Corporation, Yokohama (JP)

( * ) Notice: Subject to any disclaimer, the term of this patent is extended or adjusted under 35 U.S.C. 154(b) by 524 days.

(21) Appl. No.: 16/067,078

(22) PCT Filed: Oct. 5, 2016

(86) PCT No.: PCT/JP2016/079569
§ 371 (c)(1),
(2) Date: Jun. 28, 2018

(87) PCT Pub. No.: WO2017/221435
PCT Pub. Date: Dec. 28, 2017

(65) Prior Publication Data

US 2019/0106914 A1 Apr. 11, 2019

(30) Foreign Application Priority Data

Jun. 20, 2016 (JP) ..... JP2016-121983

(51) Int. Cl.

| | |
|---|---|
| ***E05B 83/26*** | (2014.01) |
| ***E05B 83/18*** | (2014.01) |
| ***E05B 77/36*** | (2014.01) |
| ***E05B 81/34*** | (2014.01) |
| ***E05B 81/16*** | (2014.01) |
| ***E05B 81/90*** | (2014.01) |

(52) U.S. Cl.
CPC ..... *E05B 83/26* (2013.01); *E05B 77/36* (2013.01); *E05B 81/16* (2013.01); *E05B 81/34* (2013.01);
(Continued)

(58) Field of Classification Search
CPC ..... E05B 81/14; E05B 81/06; E05B 81/34; E05B 83/18; E05B 83/16;
(Continued)

(56) References Cited

U.S. PATENT DOCUMENTS

| | | | | |
|---|---|---|---|---|
| 5,632,515 A * | 5/1997 | Dowling | ..... | E05B 81/14 292/216 |
| 5,802,894 A * | 9/1998 | Jahrsetz | ..... | E05B 77/48 292/144 |
| 6,988,749 B2 * | 1/2006 | Hashiba | ..... | E05B 81/14 292/201 |
| 7,111,877 B2 | 9/2006 | Larsen et al. | | |

(Continued)

FOREIGN PATENT DOCUMENTS

| | | |
|---|---|---|
| EP | 3085863 A1 | 10/2016 |
| JP | H07-166750 A | 6/1995 |

(Continued)

OTHER PUBLICATIONS

International Search Report for Application No. PCT/JP2016/079569 dated Dec. 1, 2016 in 1 page.

*Primary Examiner* — Mark A Williams
(74) *Attorney, Agent, or Firm* — Knobbe, Martens, Olson & Bear, LLP

(57) ABSTRACT

The present invention aims to reduce the operation noise of a latch device for a vehicle trunk lid when the lid is opened. A latch device for a vehicle trunk lid includes: latch 16 that is engaged with a striker; ratchet 18 that is engaged with latch 16; opening lever 43 that causes ratchet 18 to rotate in a direction in which ratchet 18 is disengaged from latch 16; output member 39 that rotates opening lever 43 in the release direction. Opening lever 43 is rotatable between an unblocked position where it is rotatable in the release direction and a blocked position where it is prevented from rotating in the release direction by colliding with the output
(Continued)

member. When driven and rotated, output member 39 abuts against opening lever 43 that is in the unblocked position and rotates opening lever 43 in the release direction to the blocked position, and opening lever 43 is further rotated a predetermined angle by colliding with output member 39 in the blocked position.

6 Claims, 13 Drawing Sheets

(52) U.S. Cl.
CPC ..... *E05B 81/90* (2013.01); *E05B 83/18* (2013.01); *E05Y 2900/548* (2013.01)

(58) Field of Classification Search
CPC ..... Y10T 292/1047; Y10T 292/699; Y10S 292/43; Y10S 292/42; E05Y 2900/548; E05F 15/603
See application file for complete search history.

(56) References Cited

U.S. PATENT DOCUMENTS

2005/0077734 A1* 4/2005 Lim ..... E05B 83/26 292/216
2006/0006671 A1* 1/2006 Noel ..... E05B 77/26 292/216
2008/0224482 A1* 9/2008 Gumbo ..... E05B 77/02 292/216
2011/0316293 A1* 12/2011 Luschper ..... E05B 81/14 292/195
2013/0270840 A1* 10/2013 Lujan ..... E05B 83/18 292/100
2014/0062100 A1* 3/2014 Tamura ..... E05B 81/14 292/100
2014/0203573 A1* 7/2014 Lujan ..... E05B 77/36 292/217
2016/0108647 A1* 4/2016 Scholz ..... E05B 85/243 292/195
2016/0160537 A1* 6/2016 Estrada ..... E05B 77/38 292/241
2017/0350172 A1* 12/2017 Tamura ..... E05B 79/22
2018/0087298 A1* 3/2018 Strole ..... E05B 81/16
2018/0112443 A1* 4/2018 Scocco ..... E05B 81/06

FOREIGN PATENT DOCUMENTS

JP 2001-182400 A 7/2001
JP 2014-043744 A 3/2014
JP 2014-047521 A 3/2014
JP 2015-209642 A 11/2015

* cited by examiner

LATCH DEVICE FOR VEHICLE TRUNK LID

CROSS-REFERENCE TO RELATED APPLICATIONS

This application is the U.S. National Phase under 35. U.S.C. § 371 of International Application PCT/JP2016/079569, filed Oct. 5, 2016, which claims priority to Japanese Patent Application No. 2016-121983, filed Jun. 20, 2016. The disclosures of the above-described applications are hereby incorporated by reference in their entirety.

TECHNICAL FIELD

The present invention relates to a latch device for a vehicle trunk lid (back door).

BACKGROUND ART

A Conventionally known latch device for a vehicle door is provided with a release actuator mechanism that releases a ratchet from a latch by power, for example of a motor, in order to make the vehicle door openable (JP7-166750A, JP2001-182400A, JP2014-047521A, JP2015-209642A, U.S. Pat. No. 7,111,877B). The release actuator mechanism is often used in a latch device of a slide door of a vehicle or an openable door (trunk lid or back door) of a vehicle trunk.

SUMMARY OF INVENTION

In many cases, the release actuator mechanism used in a trunk lid does not need to be combined with other mechanisms, such as a lock mechanism, a childproof mechanism, an antitheft mechanism and a one-motion mechanism, as compared to a release actuator mechanism used in a slide door. For this reason, various improvements have been made to simplify, lighten, and reduce cost of the latch device of a trunk lid. Meanwhile, there is also a strong need to reduce the operation noise.

In view of the foregoing, the present invention aims to provide a latch device for a vehicle trunk lid in which the noise operation level is reduced when the lid is opened.

A latch device for a vehicle trunk lid of the present invention includes: a latch that is engaged with a striker; a ratchet that is engaged with the latch in order to keep the latch engaged with the striker; an opening lever that is rotated in a release direction in order to abut against the ratchet and that causes the ratchet to rotate in a direction in which the ratchet is disengaged from the latch; an output member that rotates the opening lever in the release direction. The opening lever is rotatable between an unblocked position where the opening lever is rotatable in the release direction and a blocked position where the opening lever is prevented from rotating in the release direction by colliding with the output member. When the output member is driven and rotated by the release actuator, the output member abuts against the opening lever that is in the unblocked position and rotates the opening lever in the release direction to the blocked position, and the opening lever is further rotated a predetermined angle by colliding with the output member in the blocked position.

According to the present invention, the opening lever that is rotated to the blocked position abuts against the output member, and is further rotated a predetermined angle. Hence, the impact force generated when the output member abuts against the opening lever is mitigated, and noise reduction can be further improved.

LIST OF REFERENCE NUMERALS

Figure 1:
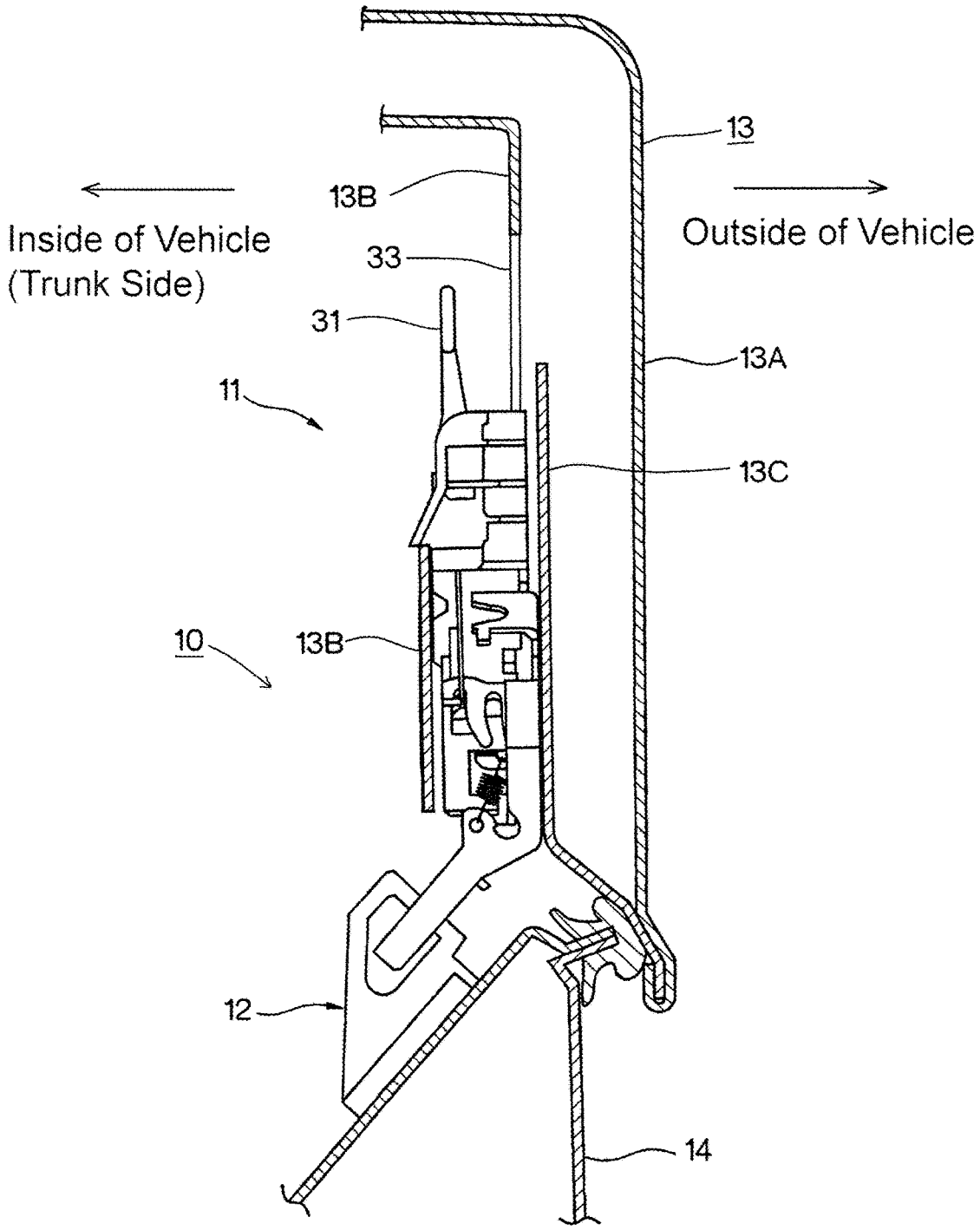
FIG. 1 is a longitudinal sectional view illustrating a latch device for a vehicle trunk lid and the trunk lid according to an embodiment of the present invention.
Figure 2:
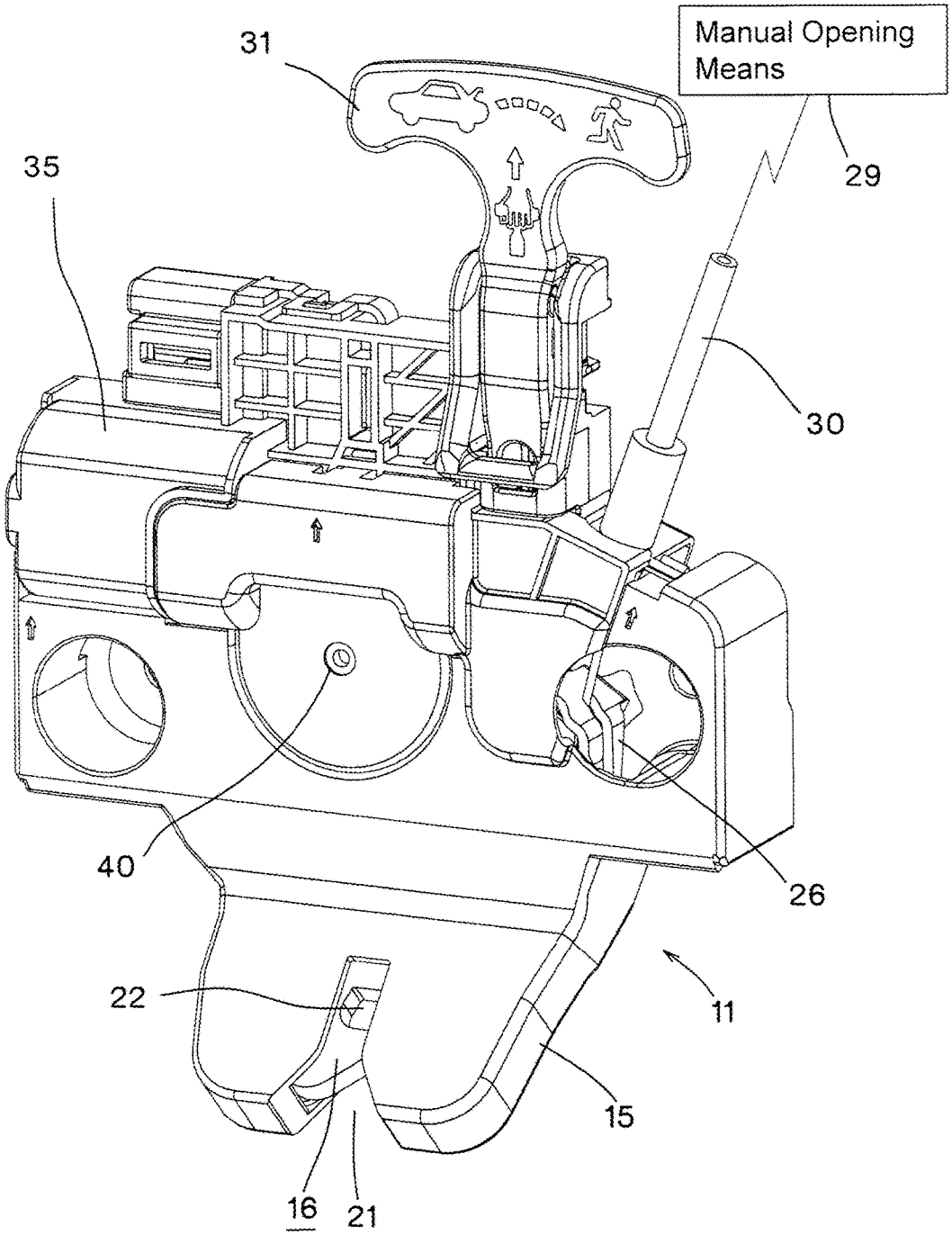
FIG. 2 is a front perspective view illustrating a latch unit of the latch device.
Figure 3:
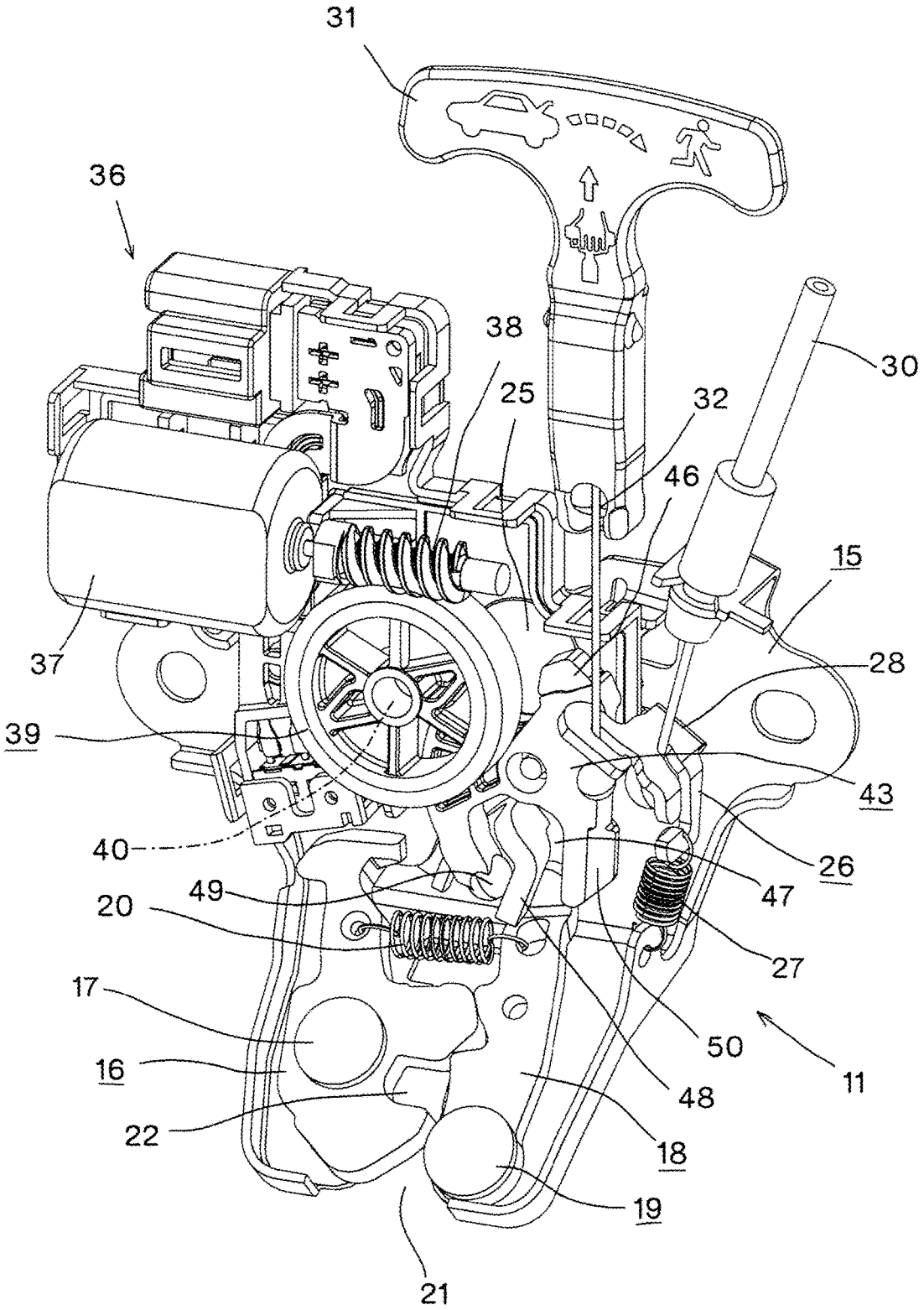
FIG. 3 is a front perspective view illustrating the inside of the latch unit.
Figure 4:
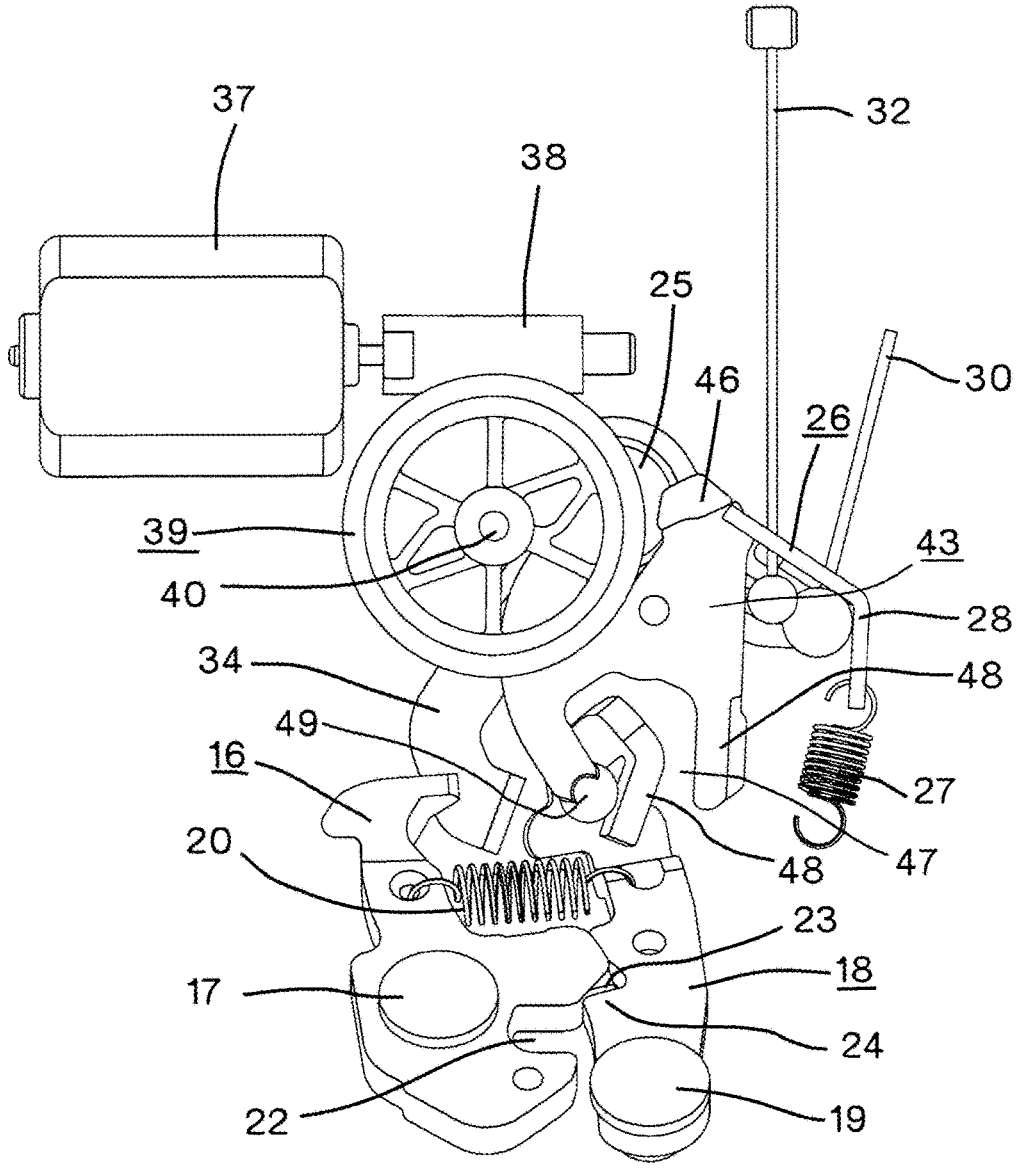
FIG. 4 is a front view of a latch/ratchet mechanism and a release actuator mechanism of the latch unit.

10 . . . latch device, 11 . . . latch unit, 12 . . . striker, 13 . . . trunk lid, 13A . . . outer metal panel, 13B . . . lining panel, 13C . . . inner metal panel, 14 . . . vehicle body, 15 . . . base plate, 16 . . . latch 17 . . . latch shaft, 18 . . . ratchet, 19 . . . ratchet shaft, 20 . . . intermeshed spring, 21 . . . striker passage, 22 . . . recess, 23 . . . latch step, 24 . . . engaging claw, 25 . . . support shaft, 26 . . . manual opening lever, 27 . . . spring, 28 . . . connection arm, 29 . . . manual opening means, 30 . . . connection tool, 31 . . . emergency operation handle, 32 . . . connection tool, 33 . . . operation opening, 34 . . . engaging arm, 35 . . . actuator housing, 36 . . . release actuator, 37 . . . motor, 38 . . . gear, 39 . . . output member, 40 . . . pivot, 41 . . . first cam protrusion, 42 . . . second cam protrusion, 43 . . . electric opening lever, 44 . . . support shaft, 45 . . . driven protrusion, 46 . . . stopper, 47 . . . forked portion, 48 . . . bent portion, 49 . . . ball-like tip end portion, 50 . . . blocking tip end portion, 51 . . . gap, 52 . . . fixed member

DESCRIPTION OF EMBODIMENT

An embodiment of latch device 10 for a trunk lid of the present invention will be described with reference to the drawings. Latch device 10 has latch unit 11 that is engaged with striker 12. Latch unit 11 is attached to trunk lid 13, and striker 12 is fixed to vehicle body 14.

Trunk lid 13 includes outer metal panel 13A that faces the outside (the outside of the vehicle), lining panel 13B that faces the inside of the trunk, and inner metal panel 13C that is positioned between outer metal panel 13A and lining panel 13B.

Latch unit 11 includes curved metal base plate 15 that extends in the vertical direction. Base plate 15 is fixed to inner metal panel 13C, for example, with bolts. In the lower part of base plate 15, latch 16 that can be engaged with striker 12 is supported by latch shaft 17, and ratchet 18, that can be engaged with latch 16, is supported by ratchet shaft 19. Spring 20 is connected both to latch 16 and to ratchet 18. Spring 20 is pre-tensioned and biases latch 16 and ratchet 18 in a direction which enables them to pull each other. These elements constitute a latch/ratchet mechanism.

When trunk lid 13 is moved in the closing direction, striker 12 enters striker passage 21 in the lower part of base plate 15, engages with recess 22 of latch 16 and rotates latch 16. When latch 16 is rotated to a latched position, engaging claw 24 of ratchet 18 engages with latch step 23 of latch 16, whereby trunk lid 13 is kept in the closed state.

Figure 5:
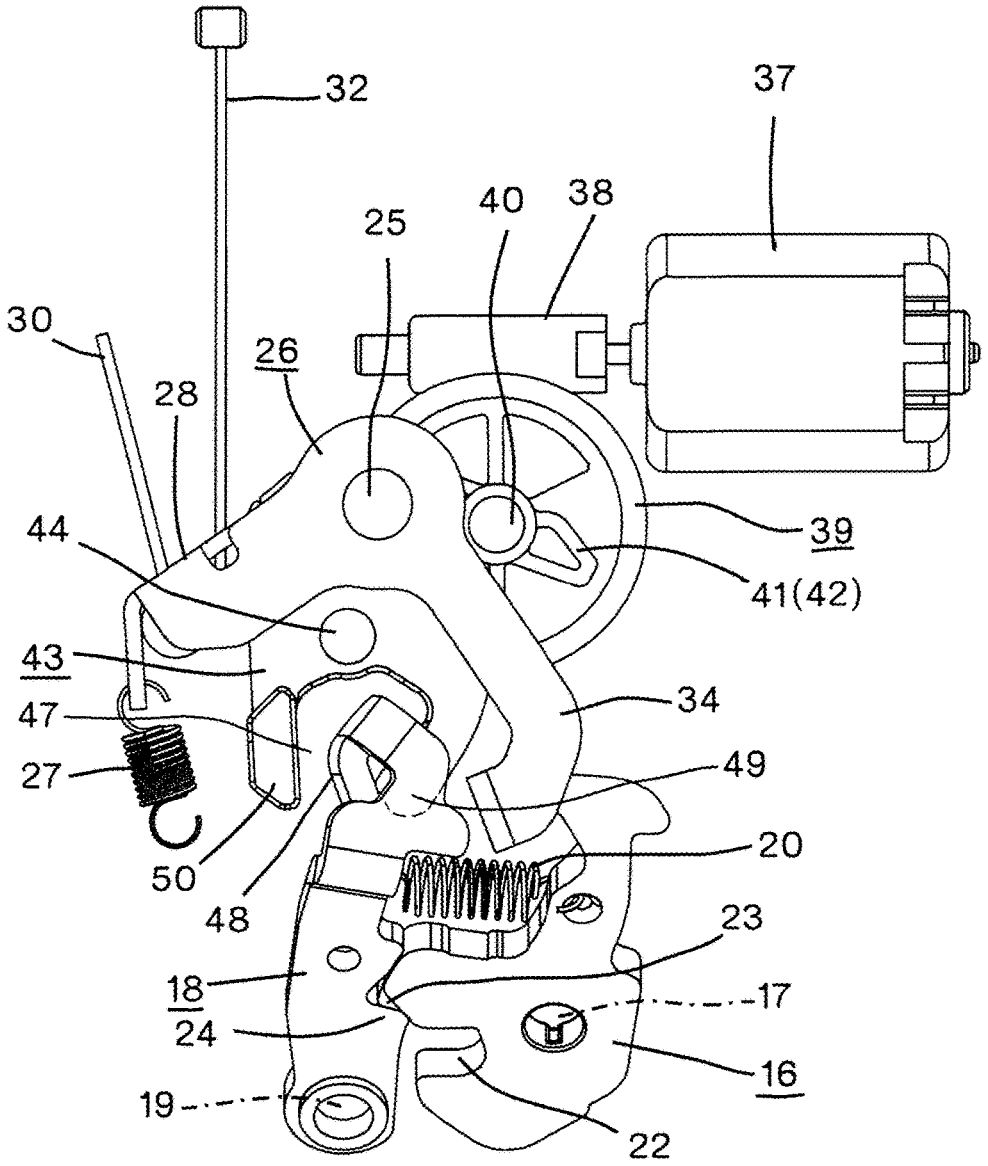
FIG. 5 is a rear view of the latch/ratchet mechanism and the release actuator mechanism of the latch unit.
Figure 6:
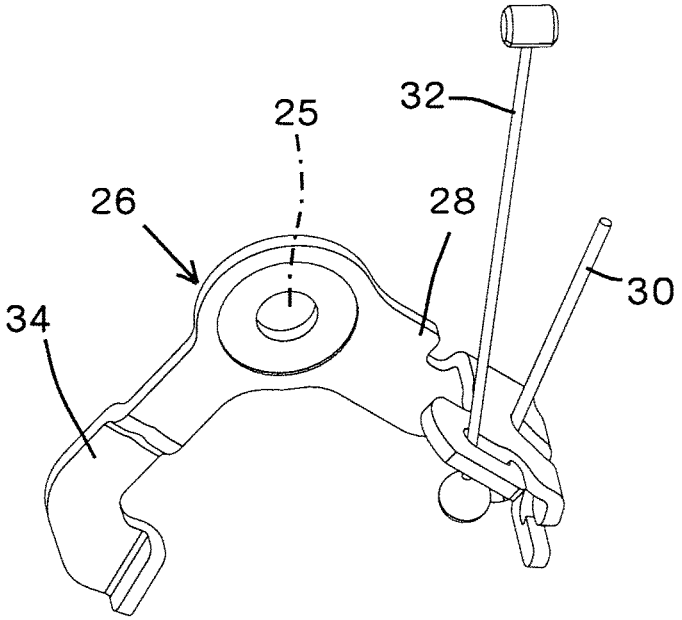
FIG. 6 is a front perspective view of a manual opening lever of the latch unit.

Manual opening lever 26 (FIG. 6) is rotatably fixed to base plate 15 by support shaft 25 (FIG. 5). Manual opening lever 26 is substantially L-shaped and is biased in the counterclockwise direction in FIG. 5 by spring 27. Connection tool 30 that is connected to manual opening means 29, such as a key cylinder or a trunk opener, and connection tool 32 that is connected to emergency operation handle 31 are engaged with connection arm 28, which is one of the arms of manual opening lever 26. Emergency operation handle 31 is exposed to the trunk through operation opening 33 of lining panel 13B. Manual opening lever 26 is rotated clockwise in FIG. 5 (release rotation) against the elastic force of spring 27 by the opening operation of manual opening means 29 or emergency operation handle 31.

The tip end of the other engaging arm 34 of manual opening lever 26 faces ratchet 18 in an engageable manner. When manual opening lever 26 is rotated in the release direction, ratchet 18 is rotated counterclockwise in FIG. 5 by manual opening lever 26 abutting against ratchet 18. Engaging claw 24 is disengaged from latch step 23, whereby latch 16 is released and trunk lid 13 enters the openable state.

Figure 7:
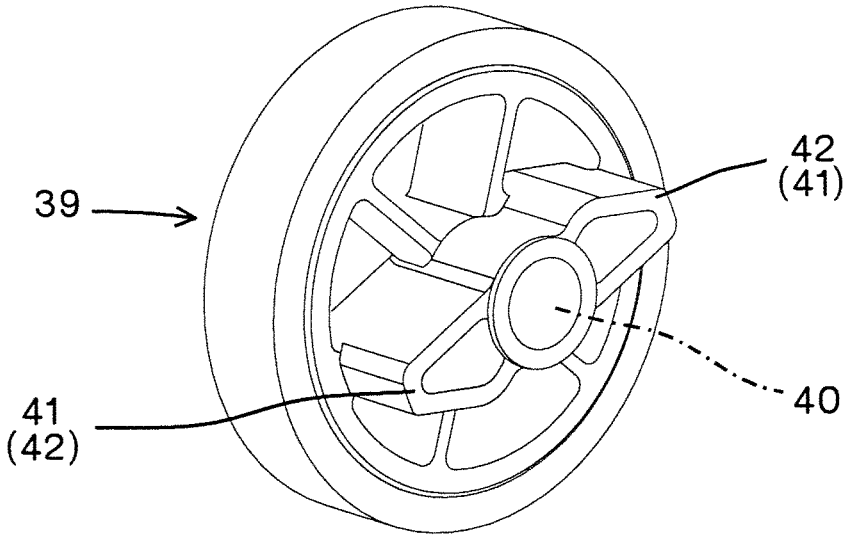
FIG. 7 is a rear perspective view of an output member of the latch unit.

Actuator housing 35 is fixed to the upper part of base plate 15. Motor-driven release actuator 36 is accommodated in actuator housing 35. Gear 38 is fixed to an output shaft of motor 37 of release actuator 36, and circular output member 39 (FIG. 7), such as a worm wheel, is meshed with gear 38. Output member 39 is rotatably fixed to actuator housing 35 (or base plate 15) by pivot 40.

A pair of first cam protrusion 41 and second cam protrusion 42 is provided integrally with and on the rear side of output member 39 such that they are arranged linearly with pivot 40 interposed therebetween. First cam protrusion 41 and second cam protrusion 42 protrude from the rear side of output member 39. Output member 39 does not include a return spring that causes output member 39 to return to a neutral position, and is therefore held in place due to the gear resistance of the reduction mechanism of release actuator 36 when motor 37 is in the OFF state.

Figure 8:
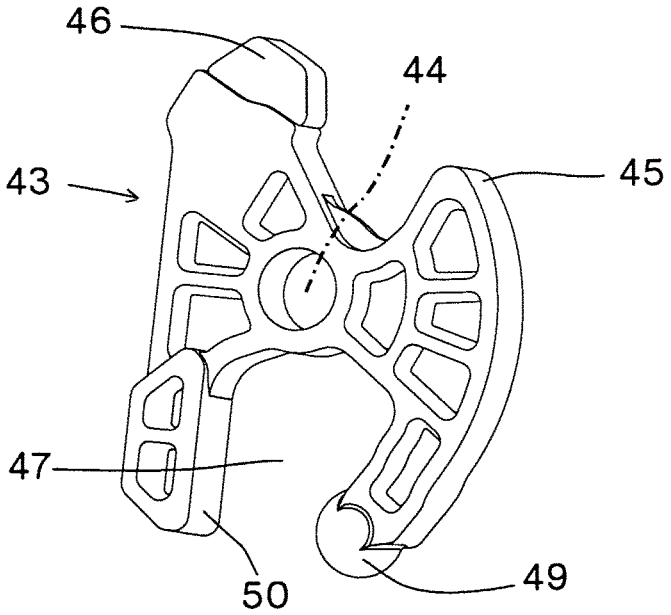
FIG. 8 is a rear perspective view of an electric opening lever of the latch unit.

Electric opening lever 43 (FIG. 8) is arranged between output member 39 and ratchet 18. Electric opening lever 43 is rotatably fixed to base plate 15 by support shaft 44. Driven protrusion 45 and rubber stopper 46 are provided in the upper part of electric opening lever 43. Driven protrusion 45 is moved between a position on the rotational trajectory of the pair of first cam protrusion 41 and second cam protrusion 42 of output member 39, and a position off the rotational trajectory. Stopper 46 also shifts between a position on the rotational trajectory of the pair of first cam protrusion 41 and second cam protrusion 42, and a position off the rotational trajectory.

Basically, the output or rotational torque of output member 39 is transmitted to electric opening lever 43 by first cam protrusion 41 or second cam protrusion 42 pushing the driven protrusion 45 in the release direction, and output member 39 is stopped by first cam protrusion 41 or second cam protrusion 42 abutting against (collides with) stopper 46. The configuration for stopping the rotation of output member 39, which will be described later in detail, is the gist of the present invention. In addition, according to the invention, quietude when rotation of output member 39 is stopped is improved and a bias spring that prevents the play of electric opening lever 43 can be eliminated.

Figure 9:
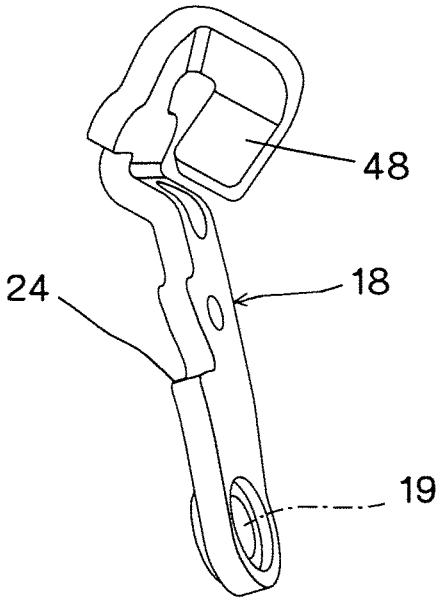
FIG. 9 is a front perspective view of a ratchet of the latch/ratchet mechanism.

Inverted U-shaped forked portion 47 is formed in the lower part of electric opening lever 43, and bent portion 48 (FIG. 9) that is provided in ratchet 18 is positioned inside forked portion 47. Bent portion 48 is provided at the tip end of ratchet 18, as seen from ratchet shaft 19, and has a shape that is formed by being turned four times in the out-of-plane direction of ratchet 18. The shape of bent portion 48 is not limited to this, and bent portion 48 may be assume any shape, as long as a surface that faces the latch is formed at the tip end of bent portion 48. When electric opening lever 43 is rotated clockwise in FIG. 5 (release rotation), ball-like tip end portion (first tip end part) 49, which is one part of forked portion 47, abuts against the front surface of bent portion 48 (a surface that faces latch 16), causes ratchet 18 to rotate counterclockwise in order to release latch 16 and put trunk lid 13 in the openable state. Blocking tip end portion 50 (second tip end part), which is the other part of forked portion 45, faces the rear surface of bent portion 48. Since bent portion 48 of ratchet 18 is positioned between first tip end part 49 and second tip end part 50 of electric opening lever 43, connection of electric opening lever 43 to ratchet 18 can be facilitated.

Figure 10:
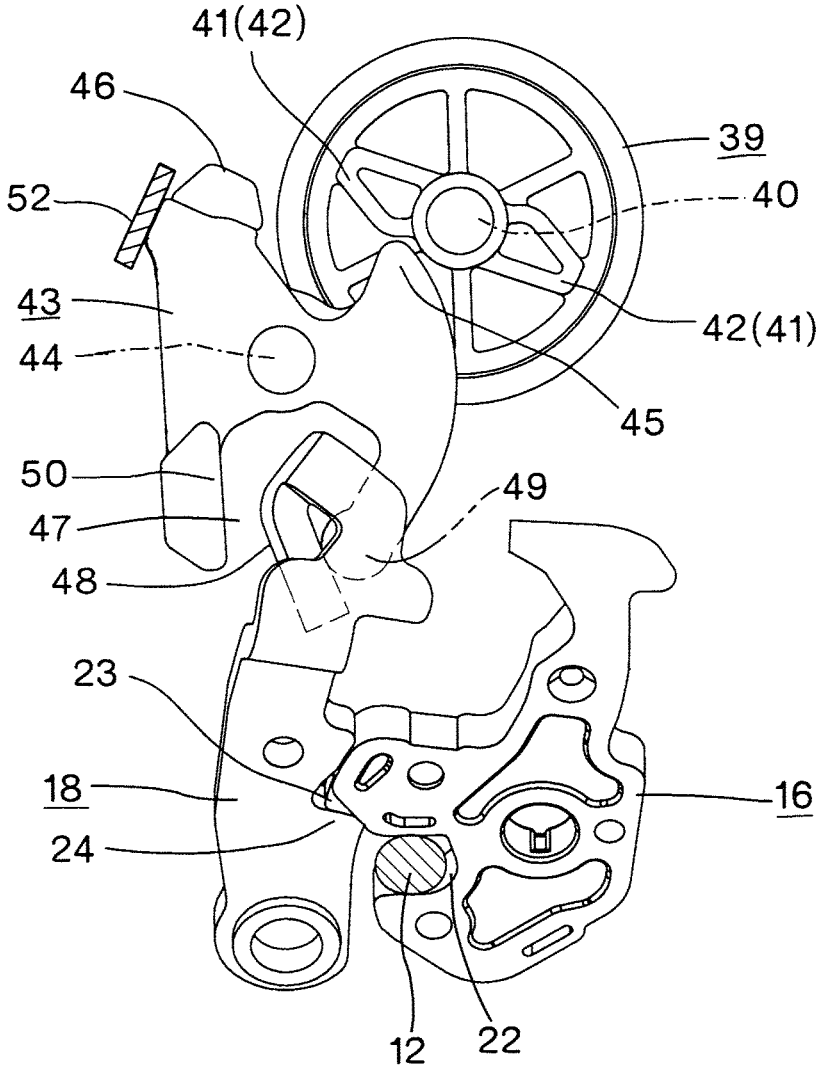
FIG. 10 is a rear view illustrating a part of the latch device in a closed state.

FIG. 10 illustrates a closed state of the trunk lid, where ratchet 18 is engaged with latch 16. In this state, first cam protrusion 41 and second cam protrusion 42 of output member 39 extend substantially horizontally. Since motor 37 is in the OFF state, output member 39 is held in the illustrated position. In the closed state, driven protrusion 45 of electric opening lever 43 is positioned on the rotational trajectory of first cam protrusion 41 and second cam protrusion 42, while stopper 46 is in an unblocked position outside of the rotational trajectory of first cam protrusion 41 and second cam protrusion 42. Electric opening lever 43 is biased in the anti-release-rotation direction by the elastic force of spring 20, through the abutting of ball-like tip end portion 49 against bent portion 48 of ratchet 18, and abuts against fixed member 52 that is provided in base plate 15 or actuator housing 35, and is thereby held without any movement. The biasing force of electric opening lever 43 in the anti-release-rotation direction may also be absorbed by bringing driven protrusion 45 into contact with a side surface of cam protrusion 41. In this case, fixed member 52 may be omitted.

Figure 11:
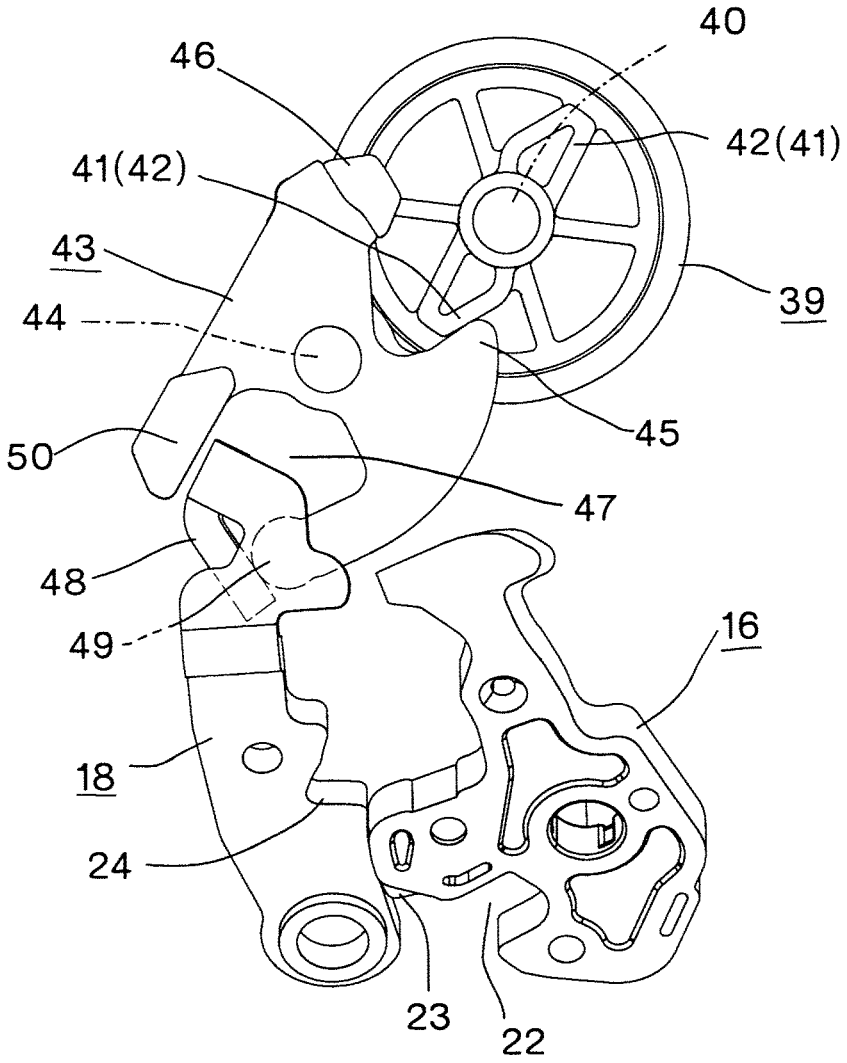
FIG. 11 is a view similar to FIG. 10, illustrating an initial opened state where the ratchet is disengaged from the latch by the rotation of the output member and the latch is rotated in the opening direction.

When output member 39 is rotated counterclockwise by motor 37 in the state in FIG. 10, first cam protrusion 41 (or second cam protrusion 42) abuts against driven protrusion 45 and rotates electric opening lever 43 clockwise (release rotation), whereby ball-like tip end portion 49 of electric opening lever 43 pushes bent portion 48 of ratchet 18 in order to cause ratchet 18 to rotate counterclockwise. Then, as illustrated in FIG. 11, ratchet 18 is disengaged from latch 16, and trunk lid 13 is opened.

When output member 39 further continues to be rotated counterclockwise, driven protrusion 45 is pushed out of the rotational trajectory of first cam protrusion 41. Stopper 46 of electric opening lever 43 is moved to a blocked position (to be more precise, the initial blocked position illustrated in FIG. 12), and stopper 46 is positioned on the rotational trajectory of second cam protrusion 42. Because stopper 46 has been already moved to the initial blocked position before output member 39 is rotated 180 degrees, when output member 39 is rotated about 180 degrees, second cam protrusion 42 abuts against stopper 46, as shown in FIG. 12.

Figure 12:
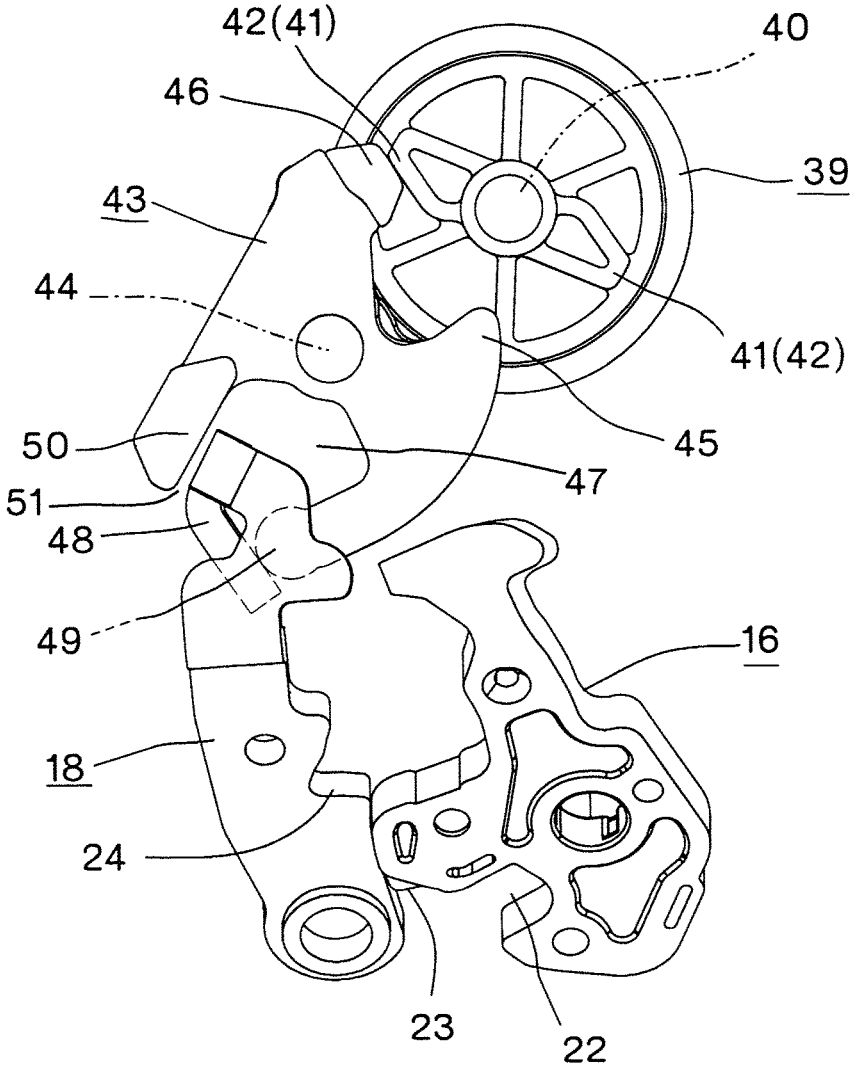
FIG. 12 is a view similar to FIG. 10, illustrating a state where a cam protrusion of the output member abuts against the stopper in the initial blocked position after the output member is rotated about 180 degrees.

In addition, in the state where second cam protrusion 42 is in contact with stopper 46 in the initial blocked position, as illustrated in FIG. 12, a predetermined amount of gap 51 is set between blocking tip end portion 50 of electric opening lever 43 and the rear surface of bent portion 48 of ratchet 18.

Since stopper 46 is made of rubber, excellent quietude can be provided when second cam protrusion 42 collides with stopper 46. In the embodiment, however, when second cam protrusion 42 collides with stopper 46, stopper 46 is moved in the direction away from second cam protrusion 42, i.e., in the anti-release-rotation direction in order to achieve further improvement of quitude. Specifically, when second cam protrusion 42 collides with stopper 46, electric opening lever 43 is moved back a distance that corresponds to gap 51 in the anti-release-rotation direction in FIG. 12. For this reason, an impact force generated when second cam protrusion 42 collides with stopper 46 is partially absorbed as a force to rotate electric opening lever 43 in the counter-release direction, whereby further improvement in quietude can be expected. Since the impact force is mitigated by the rotation of electric opening lever 43 in the counter-release direction, when electric opening lever 43 is rotated in the release direction by output member 39 next time, electric opening lever 43 will operate smoothly.

Figure 13:
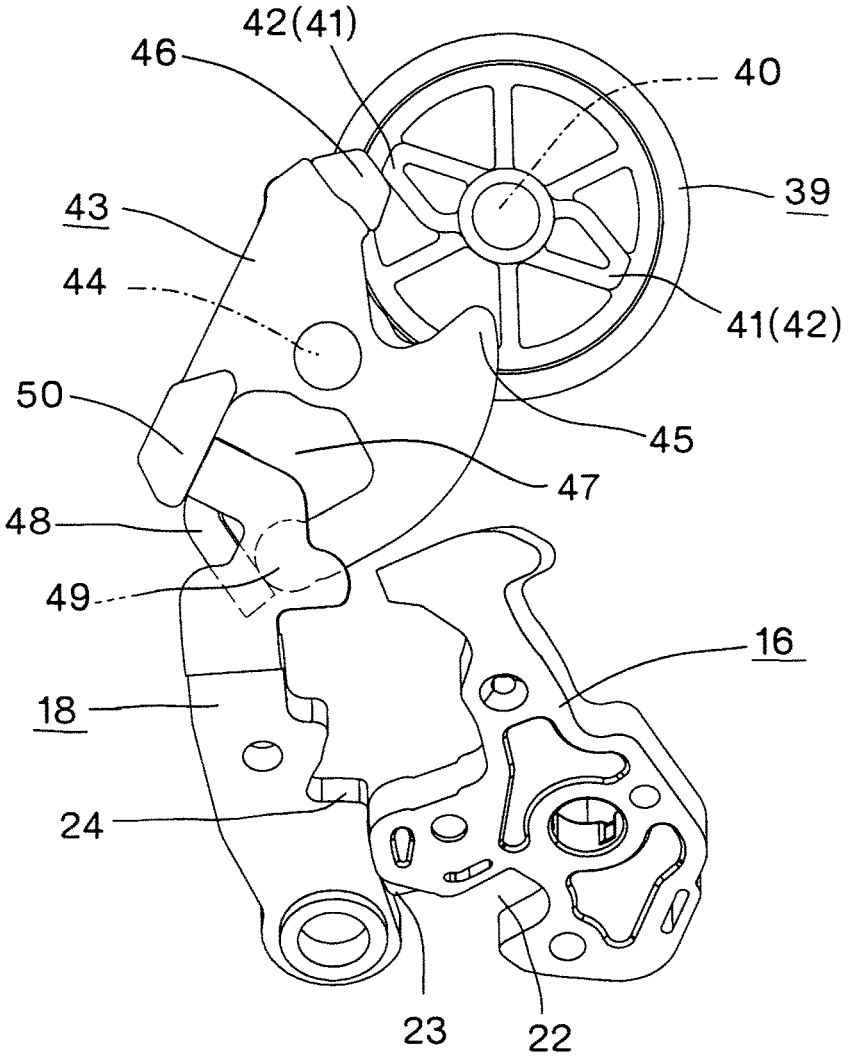
FIG. 13 is a view similar to FIG. 10, illustrating a state where the cam protrusion of the output member abuts against the stopper.

When collision of second cam protrusion 42 with stopper 46 causes electric opening lever 43 to rotate in the counter-release direction (impact absorption rotation), blocking tip end portion 50 of electric opening lever 43 abuts against the rear surface of bent portion 48 of ratchet 18, as illustrated in FIG. 13. Since ratchet 18 in the opened state is engaged with latch 16 and is therefore prevented from rotating, the impact absorption rotation of electric opening lever 43 is completed when blocking tip end portion 50 abuts against the rear surface of bent portion 48. However, since the impact force is further dispersed by blocking tip end portion 50 abutting against ratchet 18, further improvement in quietude can be expected. It should be noted that stopper 46 stays on the rotational trajectory of second cam protrusion 42 even after the impact absorption rotation of electric opening lever 43 is performed, and the position of stopper 46 at this time is a secondary blocked position. Opening lever 43 is in contact with both ratchet 18 and output member 39 and is restricted in the rotational direction by ratchet 18 and output member 39, thereby any movement of opening lever 43 is prevented.

It is desirable that power supply to motor 37 be stopped when second cam protrusion 42 collides with stopper 46 that is in the initial blocked position and that the impact absorption rotation of electric opening lever 43 be performed by the rotational inertia of output member 39. This can reduce the impact force when blocking tip end portion 50 abuts against ratchet 18.

When manual opening lever 26 is rotated clockwise in FIG. 5 (release rotation) by an opening operation of manual opening means 29 or emergency operation handle 31, engaging arm 34 abuts against ratchet 18 in order to cause ratchet 18 to rotate counterclockwise and put trunk lid 13 in an openable state. At this time, since bent portion 48 of ratchet 18 that is rotated counterclockwise pushes blocking tip end portion 50 of electric opening lever 43, electric opening lever 43 is rotated in the counter-release direction and stopper 46 is moved to the secondary blocked position. This results in the same state as when the trunk lid is opened by release actuator 36.

In the opened state of FIG. 13, when striker 12 abuts against latch 16 and latch 16 is moved to the latched position, ratchet 18 is rotated clockwise by the elastic force of spring 20 and is engaged with latch 16. Then, bent portion 48 of ratchet 18 pushes ball-like tip end portion 49 of electric opening lever 43, rotates electric opening lever 43 in the counter-release direction, and moves electric opening lever 43 from the blocked position to the unblocked position. Thus, the closed state of FIG. 10 is realized.

Output member 39 may be provided with a single cam protrusion instead of a pair of cam protrusions. In this case, output member 39 is rotated 360 degrees before reaching the initial blocked position, and is then stopped.

What is claimed is:

1. A latch device for a vehicle trunk lid, the latch device comprising:

a latch configured to be engaged with a striker in a closed state;

a ratchet configured to be engaged with the latch in order to keep the latch engaged with the striker in the closed state;

an opening lever configured to be rotated in a release direction so as to shift the latch device from the closed state to an open state, wherein the opening lever abuts against the ratchet such that rotation of the opening lever causes the ratchet to rotate in a direction in which the ratchet is disengaged from the latch;

an output member configured to rotate the opening lever in the release direction for shifting the latch devise to the open state; and a release actuator configured to drive and rotate the output member, wherein:

the opening lever is rotatable between an unblocked position where the opening lever is rotatable in the release direction and a blocked position where the opening lever is prevented from rotating in the release direction by colliding with the output member;

when the output member is driven and rotated by the release actuator, the output member abuts against the opening lever that is in the unblocked position and rotates the opening lever in the release direction to the blocked position;

the opening lever is configured to further rotate a predetermined angle after colliding with the output member in the blocked position; and the rotation of the opening lever that has been rotated to the blocked position collides with the output member is in a direction that is opposite to the release direction.

2. The latch device for a vehicle trunk lid according to claim 1, wherein:

the opening lever is configured to abut against the ratchet after the opening lever is rotated the predetermined angle;

the output member is configured to further rotate after the output member collides with the opening lever; and the opening lever is restricted by the ratchet and the output member.

3. The latch device for a vehicle trunk lid according to claim 2, wherein:

power supply to the release actuator is configured to be stopped when the output member collides with the opening lever; and the output member is configured to rotate by rotational inertia of the output member so as to implement impact absorption rotation after the power supply to the release actuator is stopped.

4. The latch device for a vehicle trunk lid according to claim 1, further comprising a manual opening lever configured to connected to manual opening means, wherein:

the manual opening lever comprises an engaging arm;

the manual opening lever is configured to rotate by an operation of the manual opening means, whereby the engaging arm abuts against the ratchet in order to cause the ratchet to rotate and to be disengaged from the latch; and the ratchet is configured to abut against the opening lever when the ratchet is rotated by the manual opening lever, and is configured to rotate the opening lever in the release direction from the unblocked position to the blocked position.

5. The latch device for a vehicle trunk lid according to claim 4, wherein:

the ratchet has a bent part on a tip end part thereof;

the opening lever comprises U-shaped forked portion with a first tip end part and a second tip end part positioned on both sides of the U-shaped forked portion, respectively; and the bent part is positioned between the U-shaped forked portion;

when the opening lever is rotated in the release direction by the output member, the first tip end part abuts against a surface of the bent part on a side of the latch in order to disengage the ratchet from the latch; and when the manual opening lever rotates the ratchet in order to disengage the ratchet from the latch, another surface of the bent part abuts against the second tip end part in order to rotate the opening lever from the unblocked position to the blocked position.

6. The latch device for a vehicle trunk lid according to claim 1, further comprising a pre-tensioned spring that is connected to the ratchet and the latch, wherein:

the opening lever abuts against a surface of the ratchet that faces the latch; and when the striker abuts against the latch and rotates the latch, the ratchet is configured to rotate in the same direction as the latch due to an elastic force of the pre-tensioned spring, and thereby the ratchet rotates the opening lever from the blocked position to the unblocked position.

* * * * *